US009863446B2

(12) United States Patent
Vela

(10) Patent No.: US 9,863,446 B2
(45) Date of Patent: Jan. 9, 2018

(54) TRIPLE PISTONS CYLINDER WITH REDUCED OVERALL LENGTH

(71) Applicant: Ilie Vela, Kitchener (CA)

(72) Inventor: Ilie Vela, Kitchener (CA)

(73) Assignee: Ilie Vela, Kitchener, Ontario (CA)

( * ) Notice: Subject to any disclaimer, the term of this patent is extended or adjusted under 35 U.S.C. 154(b) by 73 days.

(21) Appl. No.: 14/886,086

(22) Filed: Oct. 18, 2015

(65) Prior Publication Data

US 2017/0108019 A1 Apr. 20, 2017

(51) Int. Cl.
*F15B 11/036* (2006.01)

(52) U.S. Cl.
CPC ..... *F15B 11/0365* (2013.01)

(58) Field of Classification Search
CPC .... F15B 11/036; F15B 11/0365; F15B 15/16; F15B 15/165; F15B 15/17; F15B 15/1466
USPC ..... 92/52, 53, 62, 65, 108, 110, 112, 151
See application file for complete search history.

(56) References Cited

U.S. PATENT DOCUMENTS 298,224 A * 5/1884 Morgan ..... B21K 1/30 269/25
560,125 A * 5/1896 Falkenau ..... B60S 1/06 212/341
715,598 A * 12/1902 Philipp ..... F15B 3/00 100/269.14
825,866 A * 7/1906 Rogers ..... F15B 11/0365 91/32
896,571 A * 8/1908 Ocain ..... F15B 11/15 91/304
1,565,767 A * 12/1925 Westbrook ..... B60T 13/243 188/154
2,116,046 A * 5/1938 Schmutz ..... B60T 13/243 91/370
2,383,082 A * 8/1945 Rossmann ..... B21J 15/18 72/453.17
2,743,703 A * 5/1956 Miller ..... A01G 3/033 91/34
2,956,549 A * 10/1960 Malpass ..... F15B 11/0365 91/404
2,981,234 A * 4/1961 Appleton ..... F15B 15/10 92/110
2,983,256 A * 5/1961 Seeloff ..... F15B 11/0365 92/110
3,457,841 A * 7/1969 Tregaskiss ..... F15B 11/0365 29/433
4,011,724 A * 3/1977 Landes ..... F15B 11/0325 60/567

(Continued)

*Primary Examiner* — Nathaniel Wiehe
*Assistant Examiner* — Michael Quandt
(74) *Attorney, Agent, or Firm* — Ilie Vela

(57) ABSTRACT

A triple piston fluid pressure cylinder is disclosed with a parallel arrangement of the pistons that allows a combination of the first two stages of the cylinder into one stage so that the first two stages of the cylinder are working into the same common space.

As the result of that arrangement the overall length of the triple pistons cylinder is reduced by a significant amount. The saved length may be used to increase the stroke of the cylinder.

The piston body assembly is built around the piston arrangement, and is composed of a cylinder tube with one head end cover and one rod end cover and one middle fixed pistons. The middle fixed piston is extended through an extension tube to an extension fixed piston.

3 Claims, 6 Drawing Sheets

(56) References Cited

U.S. PATENT DOCUMENTS

| | | | | | |
|---|---|---|---|---|---|
| 4,296,677 | A * | 10/1981 | Little | F15B 15/1466 | 91/510 |
| 4,621,564 | A * | 11/1986 | Nishii | B60T 13/563 | 91/376 R |
| 5,245,911 | A * | 9/1993 | Yuda | F16B 3/04 | 92/128 |
| 6,029,561 | A * | 2/2000 | Naslund | F15B 15/1433 | 91/394 |
| 6,244,560 | B1 * | 6/2001 | Johnson | E21B 33/062 | 251/1.3 |
| 6,651,546 | B2 * | 11/2003 | Sandlin | F15B 7/001 | 92/112 |
| 8,166,866 | B2 * | 5/2012 | Lind | B60T 13/575 | 92/169.2 |
| 2013/0305916 | A1 * | 11/2013 | Broman | F16J 10/00 | 92/169.1 |
| 2014/0157981 | A1 * | 6/2014 | Saito | F16J 10/02 | 92/169.1 |

* cited by examiner

TRIPLE PISTONS CYLINDER WITH REDUCED OVERALL LENGTH

BACKGROUND

Field of the Invention

The present invention relates to a fluid pressure cylinder that uses fluid pressure to displace a piston assembly in an axial direction relative to a cylinder body assembly.

Description of the Related Art

In many applications there is a need for higher forces developed by the actuator, or cylinder.

The solutions existent so far is to stack multiple cylinders inline and that led to invention of the multiple piston cylinders that is practically a series of two or more pistons secured on a common rod, inside a cylinder body divided into multiple chambers.

The pistons under pressure exert an axial force on the rod and all the forces are summed and applied at the rod end of the cylinder.

The earliest patent regarding the multiple pistons cylinders are the U.S. Pat. No. 825,866 granted Jul. 10, 1906 to L. H. Rogers, U.S. Pat. No. 1,565,767 granted Dec. 1, 1922 to C. R. Westbrook, and U.S. Pat. No. 2,956,549 granted Jul. 5, 1955.

The multiple pistons cylinder has limitations regarding stroke, due to the overall length of such a cylinder.

Usually triple pistons cylinders go up to 3 or 4 inches of stroke as standard and higher strokes are custom build, and are usually extremely long, implying higher cost in building the cylinder and building longer and heavier support frames.

For example, every inch of extra stroke of the triple pistons cylinder generates three extra inches of length of the cylinder body.

OBJECT OF THE INVENTION

The principal object of the present invention is to reduce the overall length of the triple piston cylinders.

Considering actual limits accepted by the industry that reduction of overall length will allow for an increased stroke of the cylinder.

SUMMARY OF THE INVENTION

By definition the work volume of a piston in the multiple piston cylinders is called a stage. So the triple pistons cylinders have three stages.

The present invention is based on the inventor's observation, that the front two stages of a triple piston cylinder may be combined to use practically the same volume of work.

The present invention provides a solution that generates a reduction of one third of the overall length of a triple piston cylinder, compared with triple piston cylinders invented so far.

The piston assembly has a parallel arrangement of the pistons and not an inline arrangement like existing triple pistons cylinders.

The front piston is connected in parallel with the second and third piston.

The outside diameter of the front piston is connected to the internal dual piston through a piston tube and the inside diameter of the front piston is connected to the end piston through a piston rod.

The pistons arrangement generates the structure of the cylinder body assembly.

Similar to any other cylinders the body of such a cylinder is made of a cylinder tube that has a head end cover at one end and a rod end cover at the other end.

The difference consists of an additional middle fixed piston, attached inside on the cylinder tube and extended to an extension fixed piston through an extension tubular shaft.

The second piston of the piston assembly is a dual piston, meaning that the outside diameter of the dual piston is sliding on the inside surface of the cylinder tube and the inside diameter of the dual piston is sliding on the exterior surface of the extension tubular shaft.

The above and other objects, features and advantages of the present invention will become clearer through the following detailed description when taken together with the attached drawings.

DETAILED DESCRIPTION

Targeted Space of the Cylinder for Present Invention

The focus of the present invention was to combine the first two stages or the triple pistons cylinder into one common dual stage.

This endeavor led to a parallel arrangement of the three pistons of the cylinder.

The cylinder body was built around the pistons parallel arrangement.

Preferred Embodiment

Figure 1:
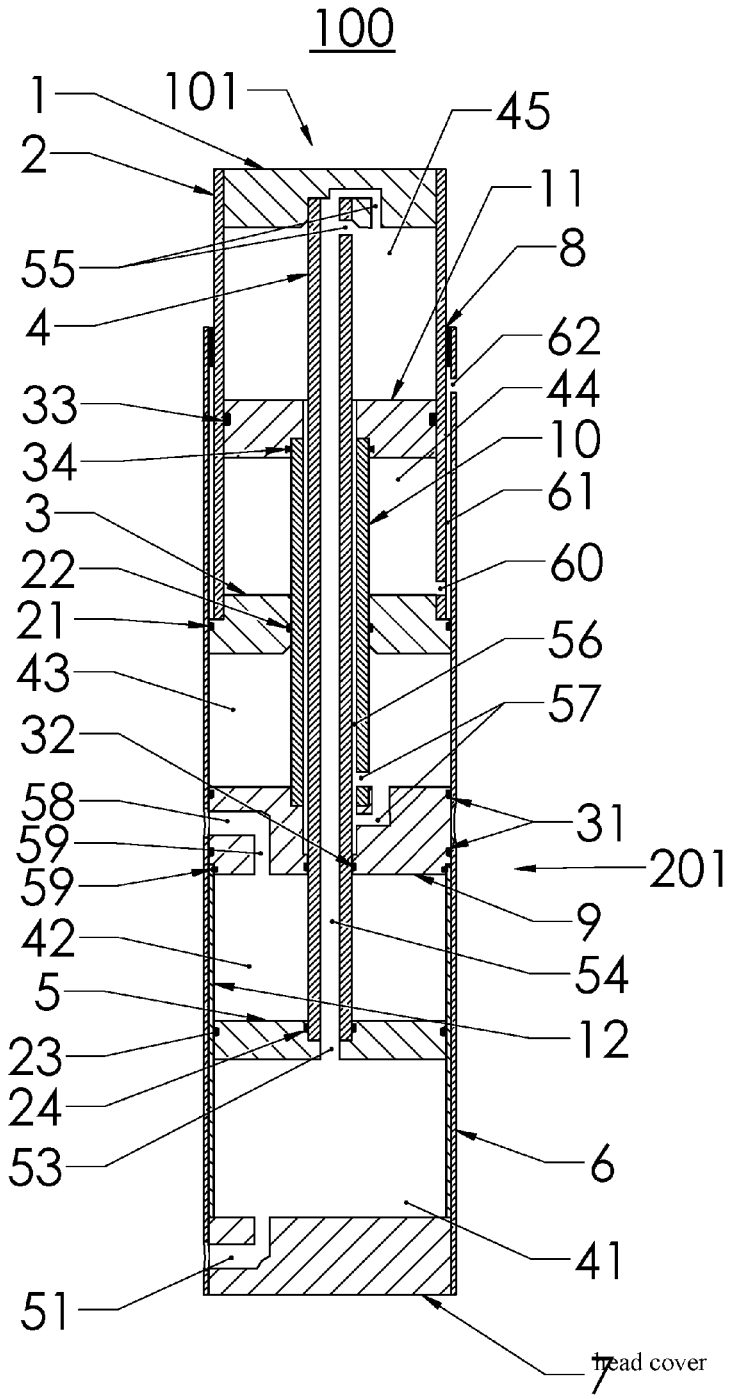
FIG. 1 shows the overall cross sectional view of the preferred embodiment of a triple pistons fluid pressure cylinder with reduced overall length.
Figure 2:
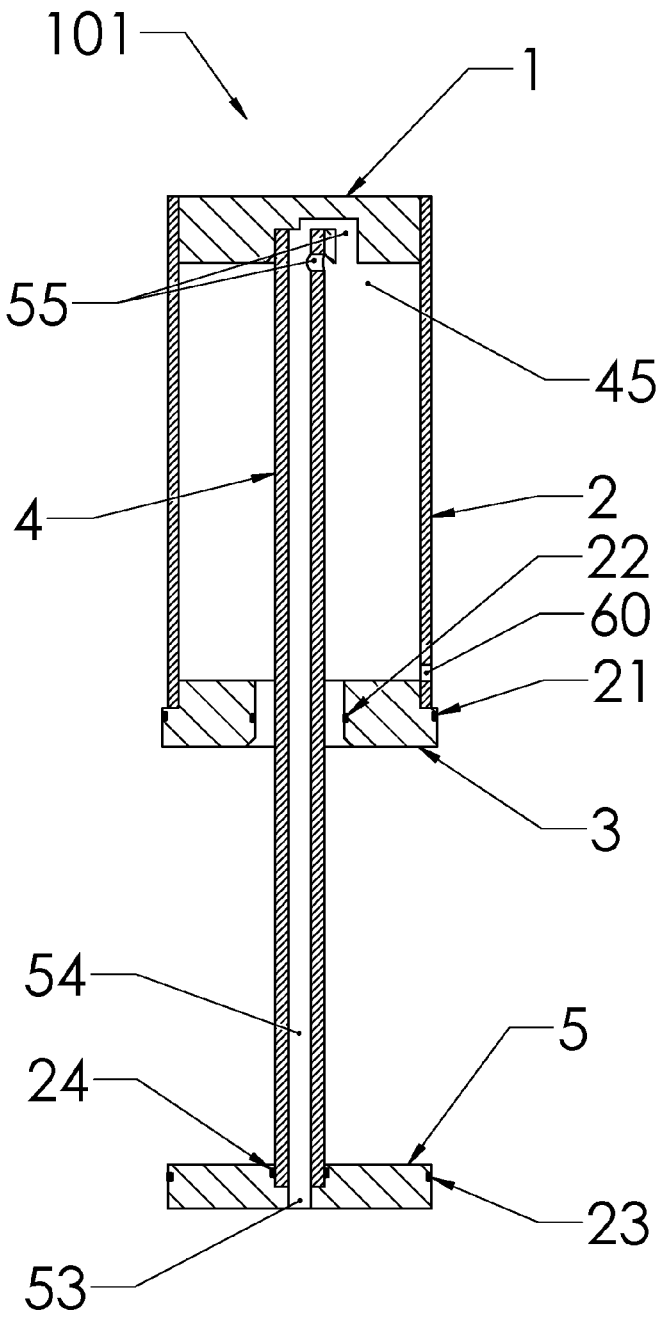
FIG. 2 shows the overall cross sectional view of the piston assembly of the preferred embodiment of a triple pistons fluid pressure cylinder with reduced overall length.
Figure 3:
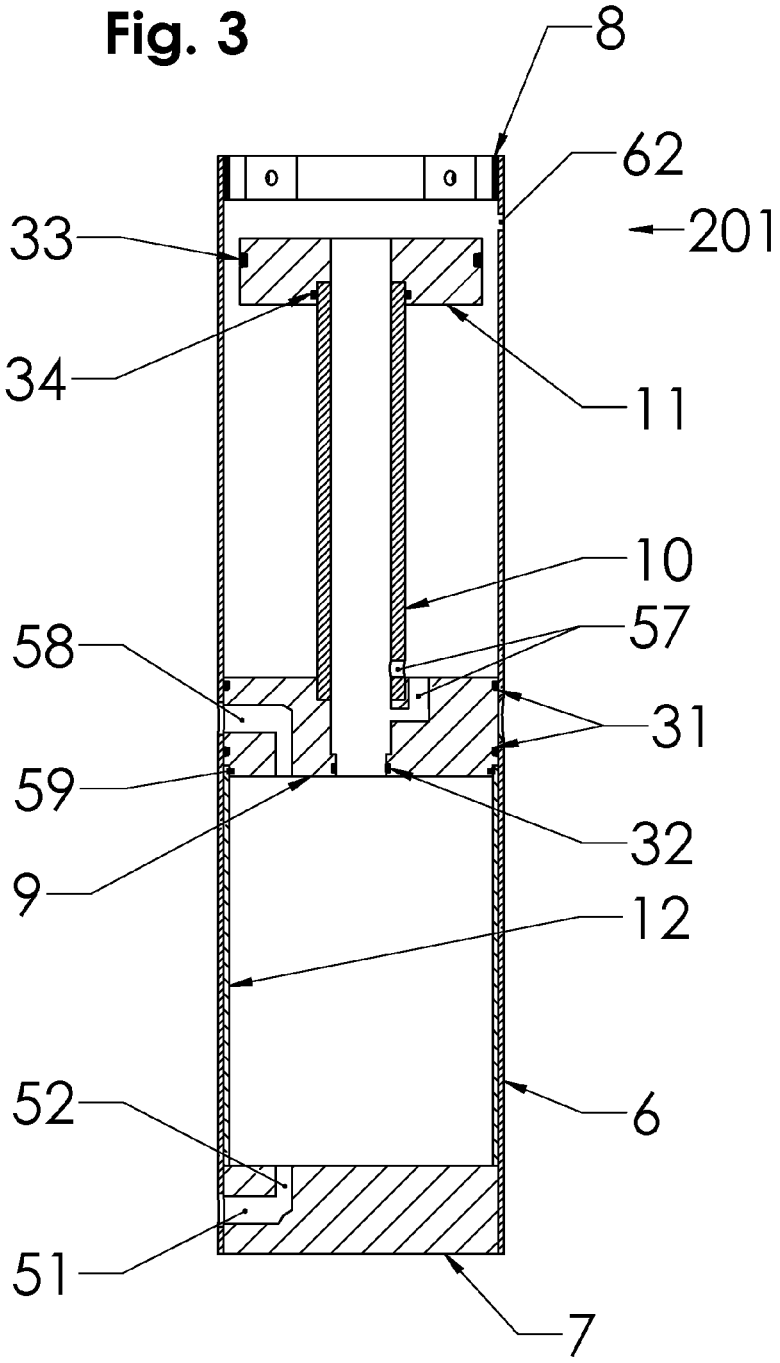
FIG. 3 shows the cross sectional view of the body assembly of the preferred embodiment of a triple pistons fluid pressure cylinder with reduced overall length.

FIGS. 1, 2 and 3 disclose such a cylinder.

The cylinder 100 is composed of a cylinder body assembly 201 and a piston assembly 101.

The cylinder piston assembly 101 is composed of a triple force ram 1, an internal dual piston 3, a tubular piston rod 4, and an end piston 5; altogether they constitute a rigid assembly.

The piston tube 2 has one or more orifices 60 in the close vicinity of one of its ends.

The triple force ram 1 is rigidly attached to the end of the piston tube 2 that has no orifices, the attachment being also air tight, not allowing any fluid leak.

Different devices may be attached on the exterior face of the triple force ram 1, like brackets, flanges, rod ends, studs, pivoting eyes, etc. that are well known in the art without departing from the scope of the present invention.

The internal dual piston 3 has a stepped outside diameter and a bore through its center, it is rigidly attached to the end of the piston tube 2 that has the orifices 60, and it has a seal 21 on its larger outside diameter and a seal 22 on its internal diameter.

The tubular piston rod 4 has a central hole 54 through and is rigidly attached at one end to the triple force ram 1.

There are one or more orifices 55 in either the piston rod 4 or the triple force ram 1, to allow fluid flow between the central hole 54 and the chamber 45.

The opposite end of the piston rod 4 is rigidly attached to the end piston 5.

The engagement of the piston rod 4 and the end piston 5 is sealed by the seal 24.

The end piston 5 has a seal 23 on the outside diameter and a central hole 53 to allow fluid flow between the chamber 41 and the central hole 54.

The cylinder body assembly 201 is composed of a cylinder tube 6, head cover 7, a rod end cover 8, an intermediate header guide 9, an extension tubular shaft 10, an extension fixed piston 11 and a spacer 12; altogether they form a rigid assembly.

The cylinder tube 6 is the exterior tube of the cylinder and has one or more orifices 62 at one of its ends.

The inside diameter of the cylinder tube 6 is larger than the outside diameter of the piston tube 2 in such a way that a chamber 61 is created in between.

The rod end cover 8 is rigidly attached at the end of the cylinder tube 6 that has the orifices 62 and is configured as a guiding ring for the piston assembly 101.

The head cover 7 has one or more inlet ports 51 and is rigidly attached to the opposite end of the cylinder tube 6 and the attachment is air tight not allowing any fluid leak.

There are one or more orifices 55 in either the piston rod 4 or the triple force ram 1, to allow fluid flow between the central hole 54 and the chamber 45.

The intermediate header guide 9 is rigidly attached inside the cylinder tube 6 in a position that will allow for an equal travel of both the end piston 5 and the internal dual piston 3.

Intermediate header guide 9 has one or more inlet ports 58 with seals 31 on both sides of the inlet ports 58.

The intermediate header guide 9 has a guiding bore through its center holding seal 32, an extension hole and a stepped outside diameter holding a seal 59.

The guiding bore of the intermediate header guide 9 is guiding the tubular piston rod 4.

The spacer 12 is attached with one end to the intermediate header guide 9 and the opposite end engages the head cover 7.

Alternatively the engagement between the head cover 7 and the spacer 12 may be sealed.

The extension tubular shaft 10 is rigidly attached to the extension hole of the intermediate header guide 9, the engagement being air tight.

The exterior diameter of the extension tubular shaft has a sealed engagement with the internal dual piston 3 by the seal 22.

The inside diameter of the extension tubular shaft 10 is larger than the exterior diameter of the tubular piston rod 4, in such a way that the space between is defining a chamber 56.

The extension tubular shaft 10 has one or more orifices 57 in the close vicinity of its attachment to the intermediate header guide 9.

Alternatively the orifices 57 can be made in the intermediate header guide 9.

The extension fixed piston 11 is rigidly attached at the opposite end of the extension tubular shaft 10, and has a sealed engagement with the piston tube 2 by seal 33.

The engagement between the extension fixed piston 11 and the extension tubular shaft 10 is sealed by seal 34.

The two cylinder assemblies 101 and 201 are moving relatively to each other guided by the seals 21, 22, 23, 32, 33 and the rod end cover 8.

When the two cylinder assemblies 101 and 201 are put together they form pressure chambers 41, 42, 43, 44 and 45.

The pressure chamber 41 is defined in between the head cover 7 and the end piston 5 inside the spacer 12.

The pressure chamber 42 is defined in between the end piston 5 and the intermediate header guide 9 inside the spacer 12.

The pressure chamber 43 is defined in between the intermediate header guide 9 and the internal dual piston 3.

The pressure chamber 44 is defined in between the internal dual piston 3 and the extension fixed piston 11 inside the piston tube 2.

The pressure chamber 45 is defined in between the extension fixed piston 11 and the triple force ram inside the piston tube 2.

When pressurized fluid is applied to the inlet port 51, the pressure is built in the chamber 41 and in the chamber 45 through the central hole 53 and the orifices 55 and in the chamber 43 through the chamber 56 and the orifices 57.

Extending forces are developed on the back of the end piston 5, the internal dual piston 3 and the triple force ram 1, and the cylinder 100 extends.

The force built on the back of the end piston 5 is transferred to the triple force ram 1 through the tubular piston rod 4.

The force built on the back of the internal dual piston 3 is transferred to the triple force ram 1 through the piston tube 2.

The triple force ram cumulates the three forces and applies them to the device attached on its exterior face.

When pressurized fluid is applied to the inlet port 58, a force builds on the front face of the end piston 5 and the cylinder 100 retracts.

The exterior diameter of the extension tubular shaft has a sealed engagement with the internal dual piston 3 by the seal 22.

The inside diameter of the extension tubular shaft 10 is larger than the exterior diameter of the tubular piston rod 4, in such a way that the space between is defining a chamber 56.

The cylinder is identical with the cylinder described as the preferred embodiment and has an additional liner 13 between the intermediate header guide 9 and rod end cover 8.

The intermediate header guide 9 has an additional stepped diameter to engage the additional liner 13, and an additional seal 59 seals the engagement between the two.

The engagement between the extension fixed piston 11 and the extension tubular shaft 10 is sealed by seal 34.

The two cylinder assemblies 101 and 201 are moving relatively to each other guided by the seals 21, 22, 23, 32, 33 and the rod end cover 8.

When the two cylinder assemblies 101 and 201 are put together they form pressure chambers 41, 42, 43, 44 and 45.

The pressure chamber 41 is defined in between the head cover 7 and the end piston 5 inside the spacer 12.

The pressure chamber 42 is defined in between the end piston 5 and the intermediate header guide 9 inside the spacer 12.

The pressure chamber 43 is defined in between the intermediate header guide 9 and the internal dual piston 3.

The pressure chamber 44 is defined in between the internal dual piston 3 and the extension fixed piston 11 inside the piston tube 2.

The pressure chamber 45 is defined in between the extension fixed piston 11 and the triple force ram inside the piston tube 2.

When pressurized fluid is applied to the inlet port 51, the pressure is built in the chamber 41 and in the chamber 45 through the central hole 53 and the orifices 55 and in the chamber 43 through the chamber 56 and the orifices 57.

Extending forces are developed on the back of the end piston 5, the internal dual piston 3 and the triple force ram 1 and the cylinder 100 extends.

The force built on the back of the end piston 5 is transferred to the triple force ram 1 through the tubular piston rod 4.

The force built on the back of the internal dual piston 3 is transferred to the triple force ram 1 through the piston tube 2.

The triple force ram cumulates the three forces and applies them to the device attached on its exterior face.

When pressurized fluid is applied to the inlet port 58, a force builds on the front face of the end piston 5 and the cylinder 100 retracts.

Second Possible Embodiment

Figure 4:
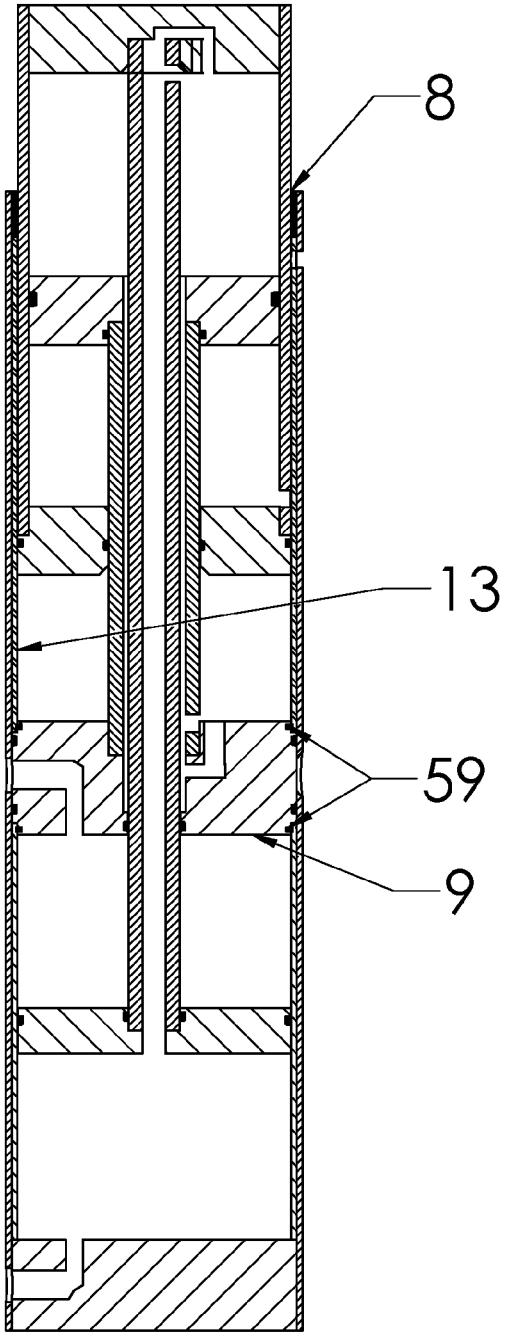
FIG. 4 shows the overall cross sectional view of the second embodiment of a triple pistons fluid pressure cylinder with reduced overall length.
Figure 5:
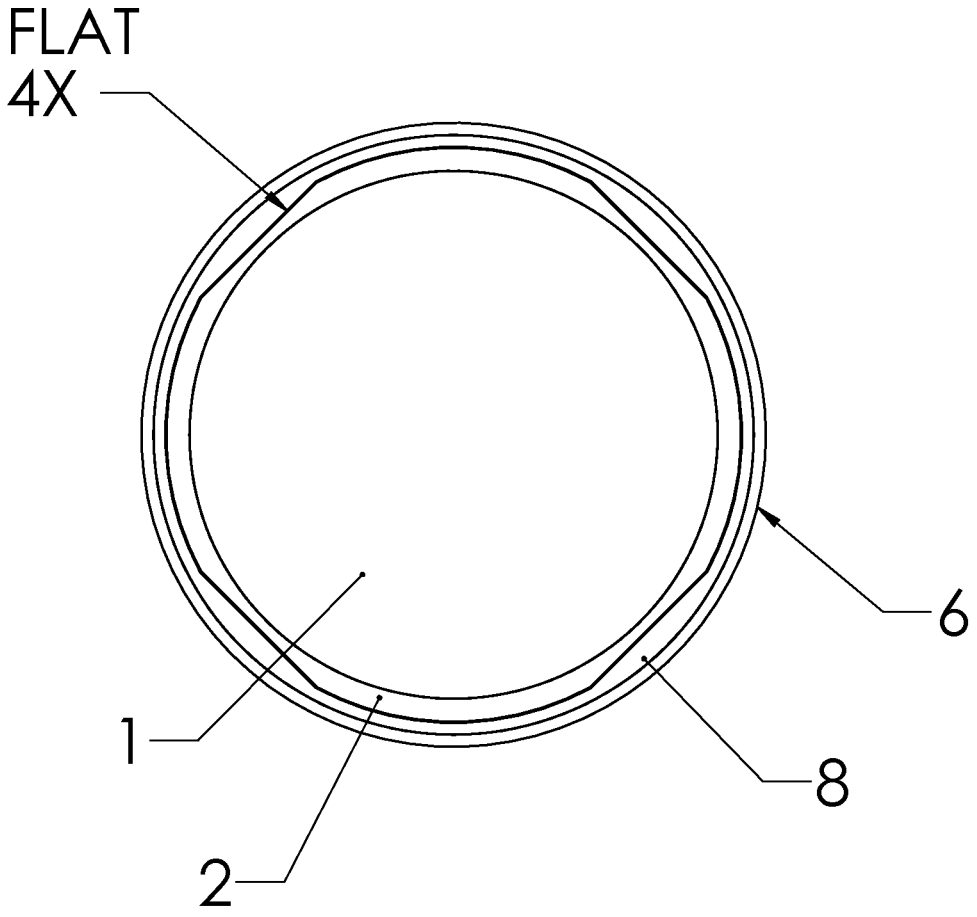
FIG. 5 shows the rod end view of the rod end cover with flats.
Figure 6:
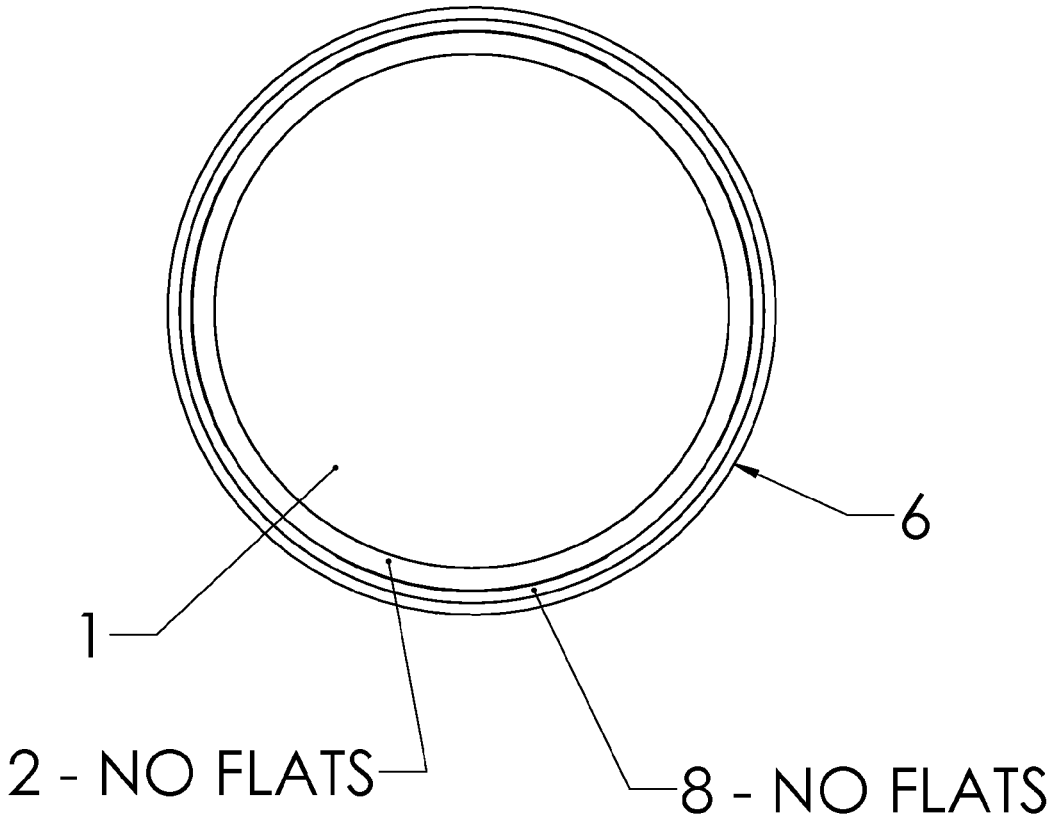
FIG. 6 shows the rod end view of the rod end cover without flats

The FIG. 4 discloses a second possible embodiment of the present invention.

The cylinder is identical with the cylinder described as the preferred embodiment and has an additional liner 13 between the intermediate header guide 9 and rod end cover 8.

The intermediate header guide 9 has an additional stepped diameter to engage the additional liner 13, and an additional seal 59 seals the engagement between the two.

INTENDED USE

The present invention may be used for applications that require an increased thrust force within limited spaces and related length restrictions accepted by the industry, like: a) clamping parts in fixtures for production processes in confined spaces, b) resistance welding cylinders that require high clamping force to produce a welding nugget, or c) processes that require the use of presses and stamping machines.

What is claimed is:

1. A fluid pressure cylinder comprising:

a) a cylinder body assembly that is made of the following rigidly attached components, a cylinder tube with one or more orifices in the vicinity of one end, a rod end cover rigidly attached at the end of the cylinder tube that has orifices, a head cover that has one or more inlet ports and is attached rigidly and air tightly at the opposite end of the cylinder tube, an intermediate header guide that has one or more inlet ports, sealed on both sides, one central guiding hole that holds a seal, one stepped outside diameter holding a seal and the intermediate header guide is rigidly attached at an intermediate position to the middle of the cylinder tube, an extension tubular shaft that is attached rigidly to the intermediate header guide, an extension fixed piston with the interior diameter attached rigidly and air tightly to the opposite end of the extension tubular shaft, a spacer between the head cover and the intermediate header guide, b) a cylinder piston assembly that is made of the following rigidly attached components, a piston tube with one or more orifices in the vicinity of one end, a triple force ram with an exterior diameter attached to the piston tube end that has no orifices, a piston rod with a central hole, and with an end of the piston rod rigidly attached in the center of the triple force ram, an internal dual piston with the exterior diameter attached rigidly to the end of the piston tube that has orifices, and has a sealed engagement with the cylinder tube on the outside diameter, and a sealed engagement with the extension tubular shaft on the internal diameter, an end piston attached rigidly and air tightly at the opposite end of the piston rod and having a sealed engagement with the spacer on the outside diameter of the end piston.

2. A fluid pressure cylinder comprising:

a) a cylinder body assembly that is made of the following rigidly attached components, a cylinder tube with one or more orifices in the vicinity of one end, a rod end cover rigidly attached at the end of the cylinder tube that has orifices, a head cover that has one or more inlet ports and is attached rigidly and air tightly at the opposite end of the cylinder tube, an intermediate header guide that has one or more inlet ports, sealed on both sides, one central guiding hole that holds a seal, one stepped outside diameter holding a seal and the intermediate header guide is rigidly attached at an intermediate position to the middle of the cylinder tube, an extension tubular shaft that is attached rigidly to the intermediate header guide, an extension fixed piston with the interior diameter attached rigidly and air tightly to the opposite end of the extension tubular shaft, a spacer between the head cover and the intermediate header guide, b) a cylinder piston assembly that is made of the following rigidly attached components, a piston tube with one or more orifices in the vicinity of one end, a triple force ram with an exterior diameter attached to the piston tube end that has no orifices, a piston rod with a central hole, and with an end of the piston rod rigidly attached in the center of the triple force ram, an internal dual piston with the exterior diameter attached rigidly to the end of the piston tube that has orifices, and a sealed engagement with the extension tubular shaft on the internal diameter, an end piston attached rigidly and air tightly at the opposite end of the piston rod and having a sealed engagement with the spacer on the outside diameter of the end piston, where an additional spacer is inserted between the intermediate header guide and the head cover, where the internal dual piston has a sealed engagement with the additional spacer, and the additional spacer has a sealed engagement with the intermediate header guide.

3. A fluid pressure cylinder comprising:

a) a cylinder body assembly that is made of the following rigidly attached components, a cylinder tube with one or more orifices in the vicinity of one end, a rod end cover rigidly attached at the end of the cylinder tube that has orifices, a head cover that has one or more inlet ports and is attached rigidly and air tightly at the opposite end of the cylinder tube, an intermediate header guide that has one or more inlet ports, sealed on both sides, one central guiding hole that holds a seal, one stepped outside diameter holding a seal and the intermediate header guide is rigidly attached at an intermediate position to the middle of the cylinder tube, an extension tubular shaft that is attached rigidly to the intermediate header guide, an extension fixed piston with the interior diameter attached rigidly and air tightly to the opposite end of the extension tubular shaft, b) a cylinder piston assembly that is made of the following rigidly attached components, a piston tube with one or more orifices in the vicinity of one end, a triple force ram with an exterior diameter attached to the piston tube end that has no orifices, a piston rod with a central hole, and with an end of the piston rod rigidly attached in the center of the triple force ram, an internal dual piston with the exterior diameter attached rigidly to the end of the piston tube that has orifices, and has a sealed engagement with the cylinder tube on the outside diameter, and a sealed engagement with the extension tubular shaft on the internal diameter, an end piston attached rigidly and air tightly at the opposite end of the piston rod and having a sealed engagement with the cylinder tube.

* * * * *